US005575973A

United States Patent [19]

Choi et al.

[11] Patent Number: 5,575,973

[45] Date of Patent: Nov. 19, 1996

[54] HIGH STRENGTH HIGH TOUGHNESS SPRING STEEL, AND MANUFACTURING PROCESS THEREFOR

[75] Inventors: Hae C. Choi; Won J. Nam; Jong K. Choi; Soo D. Bark; Jong H. Choi; Jang G. Kim, all of Pohang, Rep. of Korea

[73] Assignees: Pohang Iron & Steel Co., Ltd.; Research Institute of Industrial Science & Technology, both of Kyong Sang Book-Do, Rep. of Korea

[21] Appl. No.: 501,120

[22] PCT Filed: Jun. 14, 1994

[86] PCT No.: PCT/KR94/00069

§ 371 Date: Aug. 9, 1995

§ 102(e) Date: Aug. 9, 1995

[87] PCT Pub. No.: WO95/18243

PCT Pub. Date: Jul. 6, 1995

[30] Foreign Application Priority Data

Dec. 29, 1993 [KR] Rep. of Korea ..... 1993/31040

[51] Int. Cl.[6] ..... C22C 38/46; C22C 38/48; C21D 9/02

[52] U.S. Cl. ..... 420/112; 148/580; 148/908

[58] Field of Search ..... 420/112; 148/580, 148/908

[56] References Cited

U.S. PATENT DOCUMENTS

| | | | |
|---|---|---|---|
| 4,544,406 | 10/1985 | Yamamoto et al. . | |
| 4,711,675 | 12/1987 | Yamamoto et al. . | |
| 4,795,609 | 1/1989 | Sakas et al. | 148/908 |
| 5,009,843 | 4/1991 | Sugimoto et al. . | |
| 5,286,312 | 2/1994 | Shimotsusa et al. . | |

FOREIGN PATENT DOCUMENTS

| | | | |
|---|---|---|---|
| 57-013148 | 1/1982 | Japan . | |
| 57-169062 | 10/1982 | Japan . | |
| 58-027956 | 2/1983 | Japan . | |
| 58-27957 | 2/1983 | Japan | 148/580 |
| 58-067847 | 4/1983 | Japan . | |
| 60-89553 | 5/1985 | Japan | 148/580 |
| 62-170460 | 7/1987 | Japan . | |
| 63-153240 | 6/1988 | Japan . | |
| 01184259 | 7/1989 | Japan . | |
| 01319650 | 12/1989 | Japan . | |
| 02301541 | 12/1990 | Japan . | |
| 03002354 | 1/1991 | Japan . | |

*Primary Examiner*—Deborah Yee

*Attorney, Agent, or Firm*—Webb Ziesenheim Bruening Logsdon Orkin & Hanson, P.C.

[57] ABSTRACT

A low decarburization high toughness spring steel for an automobile suspending spring, and a manufacturing process therefor, are disclosed. In this steel, the effect of the sag resistance promoting element (Si) is maximized without reducing the carbon content, so that the problems of the decarburization and the lowering of the toughness (caused by the addition of silicon) should be solved during the manufacturing of the spring steel. The spring steel of the present invention is composed of in weight %: 0.5–0.7% of C, 1.0–3.5% of Si, 0.3–1.5% of Mn, 0.3–1.0% of Cr, 0.05–0.5% of V and/or Nb, less than 0.02% of P, less than 0.02% of S, 0.5–5.0% of Ni, and other indispensable impurities, the balance being Fe.

2 Claims, 6 Drawing Sheets

HIGH STRENGTH HIGH TOUGHNESS SPRING STEEL, AND MANUFACTURING PROCESS THEREFOR

FIELD OF THE INVENTION

The present invention relates to a coil and leaf spring steel for suspending automobiles, and a manufacturing process therefor, in which the steel has superior mechanical properties and superior spring characteristics. Particularly the present invention relates to a high strength high toughness spring steel and a manufacturing process therefor, in which the decarburized layer formed during the heat treatment for improving the spring characteristics is significantly reduced, so that the fatigue properties and the sag resistance (deformation resistance) should be improved.

BACKGROUND OF THE INVENTION

Coming recently, as a measure against the environmental pollution and the atmospheric temperature rise, environmental projects relating to the combustion ratio are being worldwidely carried out. Accordingly, the automobile industries have been making efforts to reduce the weight of automobiles. In reducing the weight of automobiles, the automobile suspension spring is an important factor. However, the suspension spring has a considerable weight, and therefore it has become the object of the concern.

If the suspension spring is made to be light, the spring has to have a high stress capacity. The high stress capacity is achieved through the improvement of the fatigue strength and the sag resistance. If the fatigue strength is lowered, the fatigue life expectancy is shortened, thereby leading to an early breaking of the spring. If the sag resistance is small, the spring cannot support the automobile body, thereby leading to the contact of the automobile body with the bumper. Therefore, in order to overcome such problems, the sag resistance characteristics of the spring should be improved.

In accordance with such a trend, an Si added steel which has a superior sag resistance characteristics compared with the existing SAE6150 (Cr-V) alloy came to attract the attention of the industry. Of it, SAE9260 (1.8–2.2% Si, SUP7) has been developed into a superior material. However, it has the problems such as the shortening of the fatigue life expectancy due to the surface decarburization and the high cost for peeling the surface. In order to overcome such problems, SAE9254 was developed in which the Si content was reduced for preventing the surface decarburization without much aggravating the sag resistance, and in which Cr was added for reducing the decarburization. However, in view of the light weight of automobile which is presently emphasized, the sag resistance of SAE9254 is not satisfactory. Then a material (SRS60) having a more superior sag resistance property was proposed in Japanese Patent Publication No. Sho-57-27956, Sho-57-169062 and Sho-57-13148. This material is formed by adding a small amount of vanadium (V) into SAE9254 so as to improve the sag resistance property. This SRS60 achieved the improvements of the sag resistance property and strength, but it made no contribution to the improvement of the decarburization and the toughness.

Meanwhile, the stress capacity of springs has reached the limit owing to the development of the process and the improvement of the precision. Therefore the remaining task is to develop a high stress capacity spring material having a superior sag resistance capacity, a high elastic limit, a high fatigue strength and a high toughness even under a high stress.

In the case of the suspending spring, if the maximum design stress is improved from the conventional 110 kg/mm$^2$ to 130 kg/mm$^2$, the weight of the spring can be reduced by 25%.

Therefore, if the weight of spring is to be reduced, a spring material having a superior sag resistance characteristics is required. In this context, the addition of silicon is required, but in this case, the decarburization problem occurs during the hot rolling process and during the heat treatment. Further there is the problem that the high strength is accompanied by a low toughness. These problems have to be solved first of all.

The conventional techniques for inhibiting the decarburization are disclosed in Japanese Patent Laid-open No. Hei-2-301514, Hei-1-31960, Sho-63-216591, Sho-63-153240, Sho-58-67847, and Sho-58-27956.

According to Japanese Patent Laid-open No. Hei-2-301514 and Sho-63-153240, the content of chrome is increased to 1.5–3.0%, or lead, sulphur and calcium are added. However, the increase of the content of chrome lowers the sag resistance. Further, in the case of a similar alloy of Japanese Patent Laid-open No. Sho-62-274058, the content of silicon does not ensure the maximum level of the sag resistance characteristics.

Meanwhile, Sho-63-216591 and Sho-58-67847 propose that, the content of carbon be reduced, and copper, molybdenum, tin, antimony and arsenic be added. In this technique, there are the problems that the added elements are too expensive, and the toughness is decreased. Japanese Patent Laid-open No. Hei-1-31960 and Sho-58-27956 propose a lowering of the content of silicon. However, it cannot be expected that the decrease of the content of silicon can lead to the improvement of the sag resistance characteristics.

Meanwhile, high stress capacity materials are disclosed in Japanese Patent Laid-open No. Hei-3-2354, Hei1-184259 and Sho-62-170460. In Japanese Patent Laid-open No. Hei-3-2354, the content of carbon is reduced for improving the toughness, while molybdenum (Mo) and aluminum (A1) are added to improve the sag resistance characteristics through a grain refinement.

However, in the case of Japanese Patent Laid-open No. Hei-3-2354, the intended effect can be obtained through the distribution of the Mo precipitates. However, precipitating temperature of Mo is over 500° C., and therefore, it is difficult to maintain the strengths of the matrix. The grain refinement can be expected by adding aluminum, but non-metallic inclusions of alumina series are formed, with the result that the fatigue characteristics are adversely affected, thereby making the technique undesirable.

Japanese Patent Laid-open No. Hei-1-184259 proposed a technique of attaining to high strengths by adding Mn, Cr, V, Ni, and Mo. However, in this case, during the increase of Cr (1.0–3.5%) and Mo, the considerable improvement of the hardenability causes to form the low temperature structure (bainite and martensite structures) during the manufacturing of the material. Therefore, during the manufacturing of springs, a difficulty is encountered in peeling the surface, with the result that a softening heat treatment has to be added.

Japanese Patent Laid-open No. Sho-62-170460 proposes that the formation of the non-metallic inclusions can be reduced by adding Ca, and that the sag resistance is improved through the grain refinement by adding Ti. However, in this case, the addition of Ti causes the formation of non-metallic inclusions of Ti series, with the result that the fatigue characteristics is aggravated.

Meanwhile, Japanese Patent Laid-open No. Hei-3-2354 proposes a technique for improving the toughness.

The above patent discloses techniques of improving the toughness by reducing carbon, and by adding nickel. However, in this case, the reduction of the content of carbon causes the lowering of the yield strength, with the result that the sag resistance is aggravated.

SUMMARY OF THE INVENTION

The present inventors studied on the influence of the elements on the toughness and the decarburization, and found the following facts. The sag resistance is maximized through the addition of silicon, and the problem of decarburization caused by the addition of silicon can be solved through the addition nickel. Further, The addition of nickel is effective for improving the toughness, and thus, the inhibition of decarburization and the improvement of toughness can be simultaneously achieved.

Therefore it is an object of the present invention to provide a low decarburization high toughness spring steel, and a manufacturing process therefor, in which the effect of the sag resistance promoting element (Si) is maximized without reducing the carbon content, so that the problems of the decarburization and the lowering of the toughness (caused by the addition of silicon) should be solved during the manufacturing of the spring steel.

Meanwhile, the present inventors studied on the heat treatment conditions which give influence to the strength and toughness, and found the following facts. If an austenitic heat treatment is carried out at a temperature of 830°–870° C., and if a tempering is carried out at a temperature of 320°–420° C. after an oil quenching, then a spring steel satisfying the strength and toughness can be manufactured.

Therefore it is another object of the present invention to provide a high strength high toughness spring steel and a manufacturing process therefor, in which the heat treatment conditions are properly adjusted, so that a high strength high toughness spring steel can be manufactured.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1A:
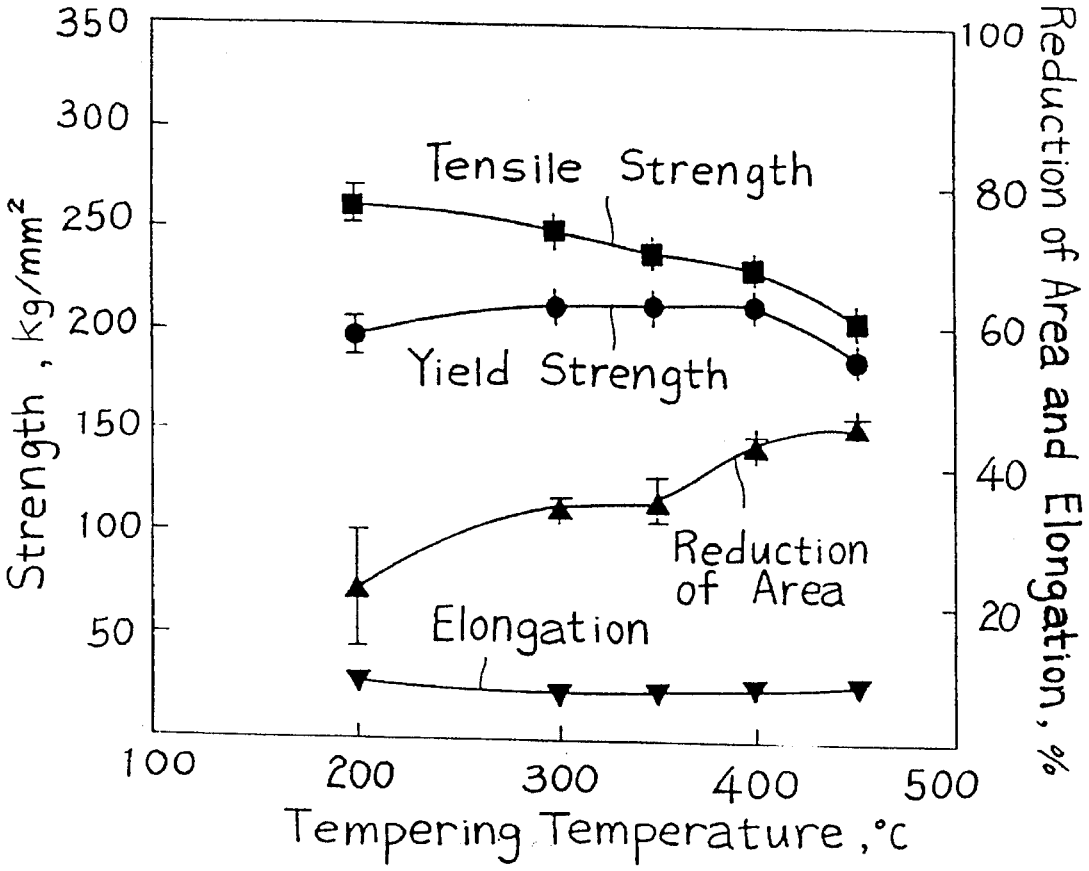
FIG. 1*a* is a graphical illustration showing the variations of the strengths, the reduction in area and the elongation versus the tempering temperature.

The present invention provides a low decarburization high toughness spring steel, and the composition includes in weight %: C (carbon): 0.5–0.7%, Si (silicon): 1.0–3.5%, Mn (manganese): 0.3–1.5%, Cr (chrome): 0.3–1.0%, V (vanadium) or Nb (niobium): 0.05–0.5%, P: less than 0.02, S: less than 0.02%, Ni: 0.5–5.0%, the balance: Fe, and other indispensable impurities.

The present invention also provides a manufacturing process for a spring steel, in which the composition of the steel includes in weight %: C: 0.5–0.7%, Si: 1.0–3.5%, Mn: 0.3–1.5%, Cr: 0.3–1.0%, V or Nb: 0.05–0.5%, Ni: 0.5–5.0%, P: less than 0.02%, S: less than 0.02%, the balance: Fe, and other indispensable impurities, the spring steel is heated to over 830° C. to austenize it, then the steel is quenched, and then, the steel is subjected to a tempering at a temperature of 320°–420° C., thereby completing the manufacturing of the high strength high toughness spring steel.

Now the reason for the limiting the elements to the above ranges will be described.

The reason for limiting the content of carbon to 0.50–0.70% is as follows. That is, if the content of carbon is less than 0.50%, a sufficient strength cannot be ensured as a high stress capacity spring steel after going through the quenching and tempering. If it is more than 0.70%, the toughness accompanied to the high strength cannot be ensured, and the decarburization due to silicon cannot be avoided.

The reason for limiting the content of silicon to 1.0–3.5% is as follows. That is, if it is less than 1.0%, silicon is dissolved in the ferrite so as not to sufficiently reinforce the strength of the matrix, and so as not to sufficiently improve the sag resistance. If it is more than 3.5%, the sag resistance effect is saturated, and decarburization is likely to occur.

In the present invention, the preferable silicon content is 2.0–3.0%, and, in this range, the matrix solution hardening effect is saturated, so that the yield strength should be improved, thereby improving the spring characteristics compared with the silicon content of 1.0–1.9%. Further the above range is advantageous because the control of the decarburization and graphitization becomes easier during the austenizing heat treatment compared with the silicon content range of 3.1–3.5%.

The reason for limiting the content of manganese to 0.3–1.5% is as follows. If it is less than 0.3%, the strength and the hardenability as a spring steel are insufficient, while if it is more than 1.5%, the toughness is decreased.

In the present invention, the more preferable range of the content of manganese is 0.3–0.6%, and the reason is that, in this range, the yield strength and the hardenability are superior even with only the alloy composition of the present invention owing to the solution hardening. The content range of manganese of 0.6–1.5% is advantageous for large springs in which the hardenability is greatly required.

The reason for limiting the content of chrome to 0.3–1.0% is as follows. That is, if it is less than 0.3%, the hardenability and the inhibition of decarburization are insufficient, while if it is more than 1.0%, the sag resistance is lowered.

In the present invention, the more preferable chrome content range is 0.3–0.6%, and the reason is that the control of decarburization is possible even only with the composition of the present invention, because the duration of the austenitic heat treatment is about 10–30 minutes. The chrome content of 0.7–1.0% is advantageous for inhibiting decarburization when manufacturing large springs in which a long time austenitic heat treatment is required.

Vanadium and niobium are for improving the sag resistance. They are added in singly or compositely. If its content is less than 0.05%, the sag resistance cannot be sufficiently improved. On the other hand, if it is more than 0.5%, its effect is saturated, with the result that large carbides are coarsened in the base metal without being solved in it. They act like a non-metallic inclusion, and therefore, the fatigue characteristics are lowered. Therefore, in the present invention, the range of the content of vanadium and niobium should be desirably limited to 0.05–0.5%.

In the present invention, the more preferable vanadium and niobium content is 0.15–0.25%, and the reason is that, in this range, the vanadium and niobium precipitates are distributed finely in the base metal, so that the sag resistance should be improved. That is, if it is less than 0.14%, the vanadium and niobium precipitates are insufficiently distributed in the base metal, so that the sag resistance cannot be sufficiently improved. If it is more than 0.26%, the vanadium and niobium precipitates are too much produced, with the result that the amount of vanadium and niobium dissolved in the matrix is increased rather than contributing to improving the sag resistance, thereby decreasing the element addition effect.

Phosphorus (P) is segregated to the grain boundaries so as to lower the toughness, and therefore, its upper limit should be 0.02%. Sulphur (S) decreases the toughness, and forms sulfides, with the result that an adverse effect is given to the spring characteristics. Therefore, its upper limit should be 0.02%.

Nickel (Ni) is added for reducing the decarburizing layer and for improving the toughness. The reason for limiting its content range to 0.5–5.0% is as follows. If it is less than 0.5%, the decarburizing and toughness improving effects are not sufficient. If it is more than 5.0%, the addition effect is saturated, so that the amount of retained austenite should be increased, thereby giving a harmful effect to the fatigue characteristics.

If there is taken into account the amount of retained austenite which gives influence to the control of decarburization during the heat treatment, to the improvement of the toughness, and to the fatigue characteristics, then the desirable content range of nickel is 1.5–2.5%.

If the nickel content is 0.5–1.4%, the decarburization can be easily controlled for materials for small springs, but during the heat treatment of large springs, the decarburization control effect is decreased due to the long time heat treatment, while the toughness cannot be sufficiently improved. If the nickel content range is 2.6–5.6%, the effect is sufficient for the decarburization, and for the improvement of the toughness and the cold forming property. However, due to the increase of the amount of retained austenite, the fatigue characteristics is gradually aggravated.

In the present invention, the reason for limiting the heat treatment conditions is as follows.

In the present invention, the heating (and maintaining) temperature before the quenching should be preferably 830° C. The reason for this is as follows. That is, if the heating temperature is below 830° C., a sufficient austenitization is cannot be realized, and therefore, a sufficient martensitic structure cannot be obtained after quenching. If the heating temperature is too high, the amount of retained austenite is increased, with the result that the fatigue life expectancy is decreased. Therefore, the upper limit should be desirably 870° C.

Further, in the present invention, the reason for limiting the tempering temperature to 320°–420° C. is as follows. If it below 320° C., the strengths and the hardness are satisfactory, but sufficient toughness and reduction in area cannot be obtained. If the temperature is over 420° C., the toughness, the strength and the hardness are lowered.

Now the present invention will be described based on the actual examples.

EXAMPLE 1

Test samples composed of as shown in Table 1 below were cast into ingots of 30 kg, and then, they were heated to and maintained at a temperature of 1200° C. for 24 hours. Then they were subjected to a hot rolling with the finishing temperature of 950° C. Under this condition, the rolling ratio was 70%.

The hot rolled material was cut into test pieces having a size of 20×30×10 mm, and then, a decarburization test was carried out. Then the depth of the decarburized layer of the ferrite was measured, and the results are as shown in Table 1 below.

Further, hardness and impact value for different tempering temperatures were measured, and the results are shown in Table 2 below.

In carrying out the decarburization test, heat treatments were carried out at temperatures of 900° C., 1000° C. and 1100° C. under the atmospheric air for two hours respectively. In order to measure the depth of the ferrite decarburization, an furnace cooling was carried out.

The depth of the decarburized layer for the test piece was measured based on KS standard (KS D 0216). According to this standard, the optical microscopic observation method and the micro-hardness measuring method are recommended, and in the present invention, the measurement of the decarburized depth of the ferrite was carried out based on the optical microscopic observation method.

The heat treating conditions for quenching and tempering for the evaluation of the impact toughness were such that a heat treatment was carried out at 850° C. for 30 minutes, then an oil quenching was carried out, and then, heat treatments were carried out in a salt bath for 30 minutes for the respective tempering temperatures (200° C., 300° C., and 400° C.). The measurement of hardness was carried out by using a Rockwell hardness tester (150 kg), while the impact test was carried out by using a Charpy tester, the notch condition being 2 mm-U notch.

TABLE 1

| | | | | | | | | | Carburizing depth (mm) of ferrite | | |
|---|---|---|---|---|---|---|---|---|---|---|---|
| Test piece | C | Si | Mn | Cr | V | Ni | P | S | 900° C. | 1000° C. | 1100° C. |
| Comprtive 1 | 0.59 | 1.60 | 0.80 | 0.80 | — | — | 0.014 | 0.013 | 0.18 | 0.27 | 0.42 |
| 2 | 0.62 | 1.60 | 0.52 | 0.52 | 0.18 | — | 0.017 | 0.018 | 0.19 | 0.28 | 0.44 |
| Inventive 1 | 0.62 | 2.51 | 0.98 | 0.51 | 0.19 | 0.56 | 0.013 | 0.015 | 0.13 | 0.20 | 0.31 |
| 2 | 0.59 | 2.42 | 0.49 | 0.49 | 0.18 | 1.52 | 0.016 | 0.017 | 0.08 | 0.18 | 0.25 |
| 3 | 0.58 | 2.63 | 1.00 | 0.51 | 0.20 | 2.50 | 0.015 | 0.018 | 0.06 | 0.13 | 0.16 |

TABLE 2

| Properties | Hardness (HRC) | | | | Impact Value (J/cm²) | | |
|---|---|---|---|---|---|---|---|
| Tempering | 0° C. | 200° C. | 300° C. | 400° C. | 200° C. | 300° C. | 400° C. |
| Comparative 1 | 63.8 | 61.2 | 59.1 | 54.0 | 12 | 17 | 28 |
| 2 | 63.3 | 60.4 | 59.3 | 53.6 | 10 | 15 | 26 |
| Inventive 1 | 64.2 | 61.9 | 59.0 | 55.8 | 14 | 26 | 29 |
| 2 | 64.7 | 60.8 | 58.5 | 55.8 | 29 | 29 | 32 |
| 3 | 63.8 | 59.5 | 58.9 | 56.7 | 42 | 34 | 40 |

As shown in Table 1, in the case of the comparative test pieces 1 and 2, decarburized depths of 0.18–0.44 mm are shown, while in the case of the test pieces 1, 2 and of the present invention, decarburized depths of 0.13–0.31 mm, 0.08–0.25 mm and 0.06–01.16 mm are shown. Therefore it is confirmed that the formation of the decarburized depth is significantly inhibited in the case of the test pieces 1, 2 and 3 of the present invention.

As shown in Table 2 above, at a tempering temperature of 400° C., the test pieces 1, 2 and 3 of the present invention are superior in the hardness compared with the comparative test pieces 1 and 2, while, in the other temperature range, they are similar with each other. In the case of the impact value, the test pieces 1, 2 and 3 of the present invention are superior in all the temperature ranges compared with the comparative test pieces 1 and 2.

As described above, in the present invention, the sag resistance which is one of the important properties of springs is improved by adding silicon. The formation of the decarburized layer which is caused by the high content of silicon can be effectively inhibited. Further, the lowering of the toughness due to the high content of silicon can be effectively overcome. Further, during the low temperature tempering which is related to high hardness, the impact value becomes superior.

EXAMPLE 2

Sample steels having the compositions as shown in Table 3 below were used to cast them into ingots of 50 kg. They were heated for 24 hours at 1200° C., and were subjected to a hot rolling with a finishing temperature of 950° C., and with a rolling ratio of 70%.

In Table 3, the comparative test piece 3 was composed of an SAE9254 steel, and the comparative test piece 4 was composed of an SAE9254 improved steel.

From the above mentioned hot rolled steels, test pieces were taken, and heat treatments were carried out. Thus the test pieces 4–10 of the present invention were maintained at 850° C. for 20 minutes, and then, were oil-quenched. Then a tempering was carried out in the temperature range of 200°–450° C. Meanwhile, the comparative test pieces 3 and 4 were maintained at 850° C. for 20 minutes, then were oil-quenched, and then, were subjected to a tempering at 410° C. in the usual manner.

TABLE 3

| Test piece | C | Si | Mn | Cr | V | Ni | P | S |
|---|---|---|---|---|---|---|---|---|
| Compara- 3 | 0.59 | 1.60 | 0.80 | 0.80 | — | — | 0.014 | 0.013 |
| tive 4 | 0.62 | 1.60 | 0.52 | 0.52 | 0.18 | — | 0.017 | 0.018 |
| Inventive 4 | 0.60 | 2.44 | 0.45 | 0.52 | 0.18 | 1.74 | 0.02 less | 0.02 less |
| 5 | 0.60 | 1.78 | 0.46 | 0.52 | 0.18 | 1.77 | " | " |
| 6 | 0.60 | 1.02 | 0.46 | 0.52 | 0.19 | 1.78 | " | " |

TABLE 3-continued

| Test piece | C | Si | Mn | Cr | V | Ni | P | S |
|---|---|---|---|---|---|---|---|---|
| 7 | 0.60 | 2.49 | 0.48 | 0.51 | 0.18 | 1.71 | " | " |
| 8 | 0.61 | 2.51 | 0.47 | 0.51 | 0.18 | 1.27 | " | " |
| 9 | 0.59 | 2.40 | 0.48 | 0.51 | 0.09 | 1.75 | " | " |
| 10 | 0.57 | 2.44 | 0.47 | 0.51 | 0.18 | 1.77 | " | " |

For the test pieces which have undergone the heat treatments, tensile strength, impact value and hardness were measured for different tempering temperatures, and the results are shown in Table 4 below.

The test pieces for testing the tensile strength were taken in the rolling direction (L direction), and were formed into the ASTM-sub size, and the tensile strength tests were carried out with a cross head speed of 5 mm/min.

The test pieces for the impact test were taken in the transverse direction to the rolling direction, and were formed based on the KS B 0809, No. 5, while the tempering was carried out in a salt bath to maintain the uniform temperature. The impact tests were carried out by using the Charpy tester, and the notch condition was 2 mm-U notch.

Hardness was tested by using a Rockwell hardness tester (150 kg).

Further, the mechanical properties of the test piece 4 of the present invention were measured for different tempering temperatures, and the results are shown in FIG. 1.

Figure 1B:
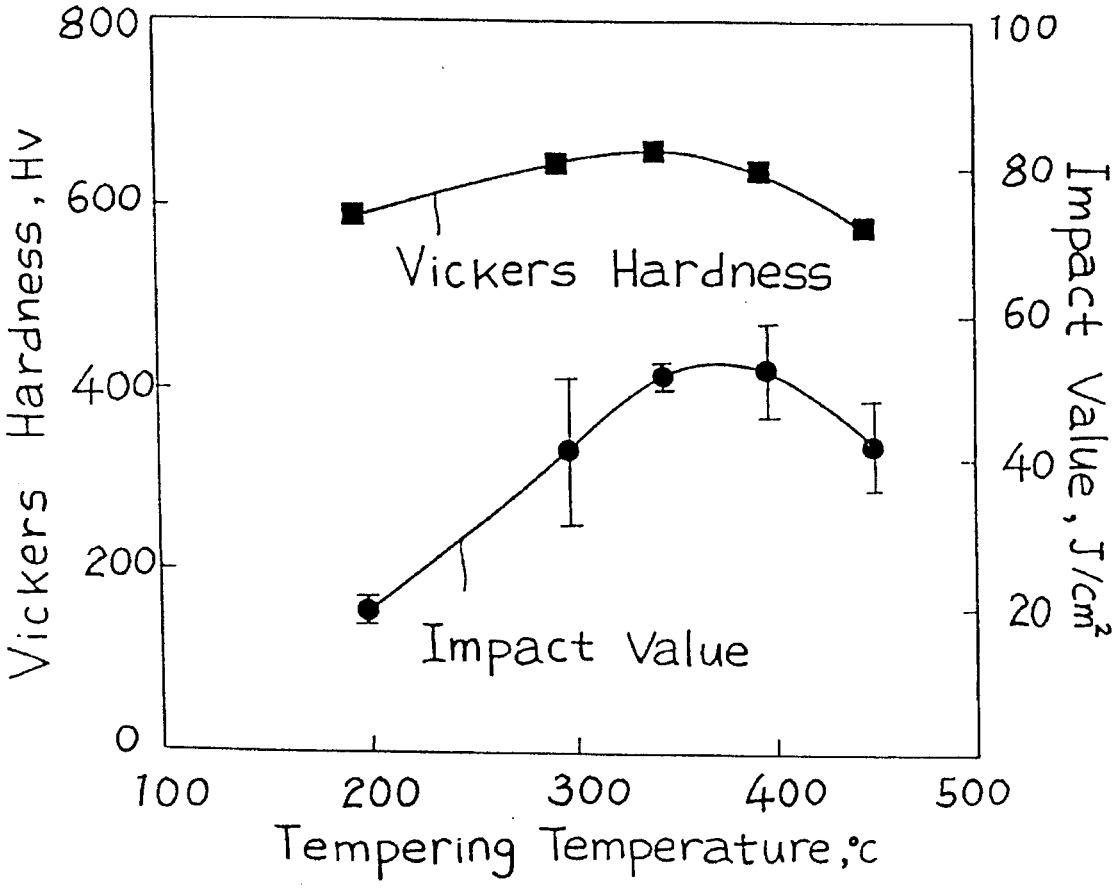
FIG. 1*b* is a graphical illustration showing the hardness (vickers scale) and the impact value versus the tempering temperature.

FIG. 1*a* illustrates the variations of the tensile strength, the yield strength, the reduction in area and the elongation versus the tempering temperatures. FIG. 1*b* illustrates the vickers hardness and the impact value versus the tempering temperatures.

Figure 2:
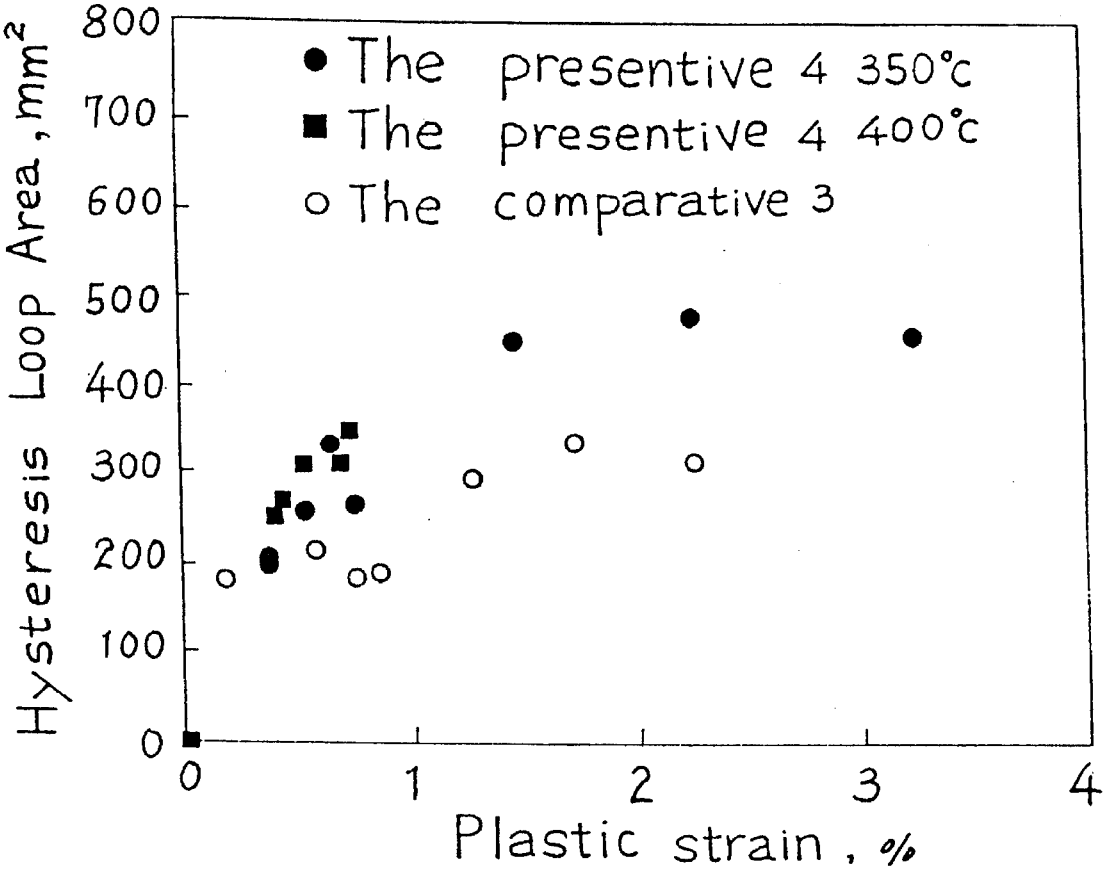
FIG. 2 illustrates the measured values of the sag resistance.

For the test pieces 4 (tempering temperature: 350° C. and 400° C.) and for the comparative test piece 3, the sag resistance was measured by measuring the hysteresis loop area which is obtained by applying tension and restoration repeatedly, i.e., by applying a plastic strain and releasing by means of the tensile tester. The results are shown in FIG. 2. Here, the large area of the hysteresis loop represents a superior sag resistance. This testing method could be used for predicting the actual direct test, and therefore, the method is applied to testing the sag resistance for springs.

TABLE 4

| Test piece | Temp °C. | Yield kg/mm² | Tensl kg/mm² | Reducn % | Hardnss HV | Impct J/cm² |
|---|---|---|---|---|---|---|
| Inventive | | | | | | |
| 4 | 350 | 216 | 243 | 34 | 663 | 52 |
| 5 | " | 221 | 243 | 36 | 661 | 46 |
| 6 | " | 208 | 229 | 46 | 656 | 41 |

TABLE 4-continued

| Test piece | Temp °C. | Yield kg/mm² | Tensl kg/mm² | Reducn % | Hardnss HV | Impct J/cm² |
|---|---|---|---|---|---|---|
| 7 | " | 215 | 246 | 30 | 635 | 33 |
| 8 | " | 220 | 251 | 31 | 675 | 49 |
| 9 | " | 223 | 251 | 40 | 673 | 38 |
| 10 | " | 220 | 245 | 41 | 656 | 55 |
| 4 | 400 | 217 | 235 | 42 | 638 | 53 |
| 5 | " | 212 | 231 | 39 | 638 | 50 |
| 6 | " | 191 | 203 | 49 | 596 | 49 |
| 7 | " | 206 | 228 | 32 | 608 | 30 |
| 8 | " | 225 | 241 | 37 | 629 | 43 |
| 9 | " | 213 | 235 | 41 | 638 | 45 |
| 10 | " | 211 | 231 | 41 | 625 | 69 |
| Comptv | | | | | | |
| 3 | 410 | 194 | 210 | 30 | 580 | 28 |
| 4 | 410 | 199 | 216 | 32 | 590 | 26 |

As shown in Table 4 above, the test pieces 4–10 of the present invention show superior mechanical properties compared with the comparative test pieces 3–4, and particularly, the test pieces of the present invention are superior in the yield strength and the impact value.

Further, as shown in FIG. 1*a*, the tensile strength and the yield strength are decreased at the tempering temperatures of over 420° C., while the reduction in area is increased as the tempering temperature is increased.

Further, as shown in FIG. 1*b*, the vickers hardness and the impact value show the maximum values near 350° C., and they are decreased near 420° C. In view of these results, the tempering temperature range which gives the most superior mechanical properties such as tensile strength, yield strength and impact value is 320°–420° C.

Meanwhile, as shown in FIG. 2, the hysteresis loop area for the test piece 4 of the present invention increases as the plastic deformation increases, compared with the comparative test piece 3. Accordingly it is confirmed that the sag resistance of the test piece 4 of the present invention is superior to that of the comparative test piece 3.

EXAMPLE 3

Sample steels having the compositions of Table 5 were cast into ingots of 50 kg, and then, they were subjected to homogenizing heat treatments at 1250° C. for 24 hours. Then they were heat-forged into 55×55 mm pieces, the finishing temperature being over 950° C., and the rolling ratio being 65%.

When manufacturing the wires, a hot rolling was carried out after heating them at 1050° C. for 2 hours, thereby forming a wire having a diameter of 13 mm.

In table 5 below, the comparative test piece 5 was composed of SAE 9254 steel, and the comparative test pieces 6–8 were composed of a high stress capacity spring steel.

TABLE 5

| Test piece | Unit: wt % C | Si | Mn | Cr | V | Ni | Mo | Remarks |
|---|---|---|---|---|---|---|---|---|
| Inventive | | | | | | | | |
| 11 | 0.57 | 2.68 | 0.52 | 0.54 | 0.20 | 2.04 | | P&S: 0.02 |
| 12 | 0.59 | 2.70 | 0.51 | 0.45 | 0.20 | 1.90 | | or less |

TABLE 5-continued

| Test piece | Unit: wt % C | Si | Mn | Cr | V | Ni | Mo | Remarks |
|---|---|---|---|---|---|---|---|---|
| 13 | 0.54 | 2.60 | 0.50 | 0.50 | 0.20 | 2.01 | | |
| 14 | 0.50 | 2.61 | 0.50 | 0.50 | 0.19 | 2.01 | | |
| Comprtv | | | | | | | | |
| 5 | 0.58 | 1.62 | 0.79 | 0.83 | | | | T[0]:25 |
| 6 | 0.39 | 2.69 | 0.81 | 0.82 | 0.20 | 1.98 | 0.4 | ppm or |
| 7 | 0.43 | 2.71 | 1.31 | 0.21 | 0.39 | 1.00 | 0.2 | less |
| 8 | 0.45 | 1.53 | 0.70 | 1.00 | 0.10 | 1.00 | 0.8 | |

The wires having a diameter of 13 mm which are manufactured in the above described manner were straightened, and were subjected to a peeling. Then test pieces 11–14 of the present invention and the comparative test piece 5 were heated to 870° C., and the comparative test pieces 6–8 were heated to 1000° C., were maintained at the temperature for 15 minutes, and then, were coiling. Then test pieces 11–14, 6–8 were subjected to a tempering at 370° C. for 90 minutes and test piece 5 was at 410° C. Then the test pieces 11–14 of the present invention and the comparative test pieces 6–8 were subjected to a hot setting in a temperature range of 210°–300° C. with a stress of 140 kg/mm², while the comparative test piece 5 was subjected to a hot setting in a same temperature range with a stress of 120 kg/mm².

Then shot peenings were carried out using cut wires of 0.8 mm, and then, a coating was carried out.

Then the test pieces 11–14 of the present invention and the comparative test pieces 6–8 were subjected to a cold setting at the room temperature with a stress of 140 kg/mm², while the comparative test piece 5 was subjected to a cold setting at the room temperature with a stress of 120 kg/mm². Thus springs A and B having the specifications of Table 6 were manufactured.

The test pieces 11–14 of the present invention were so made as to have the specification of the spring A, and the comparative test piece 5 was so made as to have the specification of the spring B, while the comparative test pieces 6–8 were so made as to have the specification of the spring A. This was based on the design stress difference.

TABLE 6

| Specifications | A | B |
|---|---|---|
| Wire diameter (mm) | 11.0 | 11.6 |
| Spring constant | 1.8 | 1.8 |
| Average coil diameter (mm) | 139 | 141 |
| Total number of turns | 5.19 | 6.01 |
| Effective number of turns | 3.69 | 4.51 |
| height of the spring (mm) | 355 | 355 |
| Design stress (kg/mm²) | 130 | 110 |
| Weight (kg) | 1.5 | 2.0 |
| Weight reduction rate (%) | 25 | |

For the springs manufactured in the manner described above, the fatigue characteristics and the residual shear strain (τ) were measured.

Here, the test conditions for the fatigue test and the residual shear strain were as shown in Tables 7 and 8 below. In the case of the fatigue test, the test speed was 1.3 Hz.

TABLE 7

| | A | B |
|---|---|---|
| Fatigue test load (Kg) | 207–466 | 207–466 |
| Fatigue test stress (kg/mm$^2$) | 58–130 | 48–110 |
| Average stress (kg/mm$^2$) | 94 | 79 |
| Stress amplitude (kg/mm$^2$) | ±36 | ±31 |

TABLE 8

| Test piece | Test Stress (kg/mm$^2$) | Static Rm temp | Static High temp | Dynamic Rm temp | Remarks |
|---|---|---|---|---|---|
| Comparative | 110<br>130<br>140 | 24° C.<br>72 hrs | 80° C.<br>72 hrs | Test stress<br>48–110 | Dynamic test carried out $2 \times 10^5$ times after fatigue test. |
| Inventive | 130<br>140 | | | Test stress<br>58–130 | Load variation test measured at 189 mm before & after test. |

In the case of the test pieces of the present invention, the fatigue tests were made under the test condition A of Table 7, and the fatigue test for the comparative test piece 5 was carried out under the test condition B of Table 7, while the fatigue tests of the comparative test pieces 6–8 were carried out under the test condition A of Table 7. The fatigue life expectancy was decided by the average value after carrying out the tests for 6 times. Here, the formula for calculating the spring test stress is as follows:

$$R=(8PD/\pi d^3)K$$

assuming that: R: spring test stress
P: load
D: Average coil diameter
d: wire diameter
K: Wahl's coefficient (A coefficient depending upon the shape of a coil spring)

In the above, K is defined as follows.

$$K=\frac{4C-1}{4C-4}+\frac{0.615}{C}\quad (C=D/d)$$

The test for the sag resistance was carried out under the test condition of Table 8, and the dynamic test was carried out at the fatigue life expectancy of 200,000 strokes, while the static test was carried out after maintaining the test piece at the room temperature and at a high temperature (80° C.) for 72 hours respectively.

The measurement criterium for the sag resistance was the load variation amount ΔP (load before the test minus the load after the test) which is required when the spring is compressed to the same height (189 mm) before and after the test. The formula for calculating this is as follows.

$$\tau=(8D/\pi d^3G)\Delta P$$

where τ: the residual shear strain,
D: the average coil diameter (mm)
d: the wire diameter (mm)
G: shear modulus (8000 kg/mm$^2$)
ΔP: the load variation amount (kg).

The measured fatigue characteristics and the residual shear strain τ for the springs manufactured in the above described manner are shown in Table 9 below.

TABLE 9

| Test pc | Fatigue Stress (kg/mm$^2$) | Life | Residual shear strain τ: Rm temp Static 72 hrs | Dynamic $2 \times 10^5$ | High temp Static 72 hrs |
|---|---|---|---|---|---|
| Invnt 11 | 130 | $\geqq 5 \times 10^5$ | $1.1 \times 10^{-4}$ | $1.1 \times 10^{-4}$ | $3.9 \times 10^{-4}$ |
| 12 | " | $\geqq 5 \times 10^5$ | $1.2 \times 10^{-4}$ | $1.1 \times 10^{-4}$ | $3.7 \times 10^{-4}$ |
| 13 | " | $\geqq 4 \times 10^5$ | $1.3 \times 10^{-4}$ | $1.3 \times 10^{-4}$ | $4.0 \times 10^{-4}$ |
| 14 | " | $\geqq 5 \times 10^5$ | $1.3 \times 10^{-4}$ | $1.2 \times 10^{-4}$ | $4.2 \times 10^{-4}$ |
| Compt 5 | 110 | $\geqq 2 \times 10^5$ | $1.9 \times 10^{-4}$ | $1.7 \times 10^{-4}$ | — |
| 6 | 130 | — | $1.4 \times 10^{-4}$ | — | $7.8 \times 10^{-4}$ |
| 7 | 130 | — | $1.2 \times 10^{-4}$ | — | $4.0 \times 10^{-4}$ |
| 8 | 130 | $\geqq 3 \times 10^5$ | — | — | $5.5 \times 10^{-4}$ |

Further, the residual shear strain τ was measured for the test piece 11 of the present invention and the comparative test pieces 5 and 6 under the test stress conditions of Table 10 below. The measured results are shown in Table 10 below.

TABLE 10

| Test pc | Residual shear strain τ: Test stress ($kg/mm^2$) | Rm temp static (72 hrs) |
|---|---|---|
| Inventive 11 | 140 | $1.3 \times 10^{-4}$ |
| Comparative 5 | 130 | $6.8 \times 10^{-4}$ |
| 6 | 140 | $2.2 \times 10^{-4}$ |

As shown in Table 9 above, when the test pieces 11–14 of the present invention were tested under a test stress of 130 $kg/mm^2$, they showed superior fatigue life expectancy and sag resistance compared with the comparative test piece 5. Further, they showed superior fatigue life expectancy compared with the comparative test pieces 6–8 which were tested under a test stress of 130 $kg/mm^2$. Further, they showed superior levels in the dynamic and static sag resistances compared with the comparative test pieces 6–8.

Further, as shown in Table 10 above, when tested under a test stress of 140 $kg/mm^2$ the test piece 11 of the present invention showed superior sag resistance compared with the comparative test pieces 5–6.

EXAMPLE 4

Test pieces were formed based on the composition of Table 5 of Example 3, and based on the manufacturing conditions of Example 3. Then, the static sag resistance and the dynamic sag resistance versus the test time period were measured for the test piece 11 of the present invention and the comparative test piece 5. The dynamic sag resistance thus measured is shown in FIG. 3, while the room temperature static sag resistance is shown in FIGS. 4 and 5.

Figure 4:
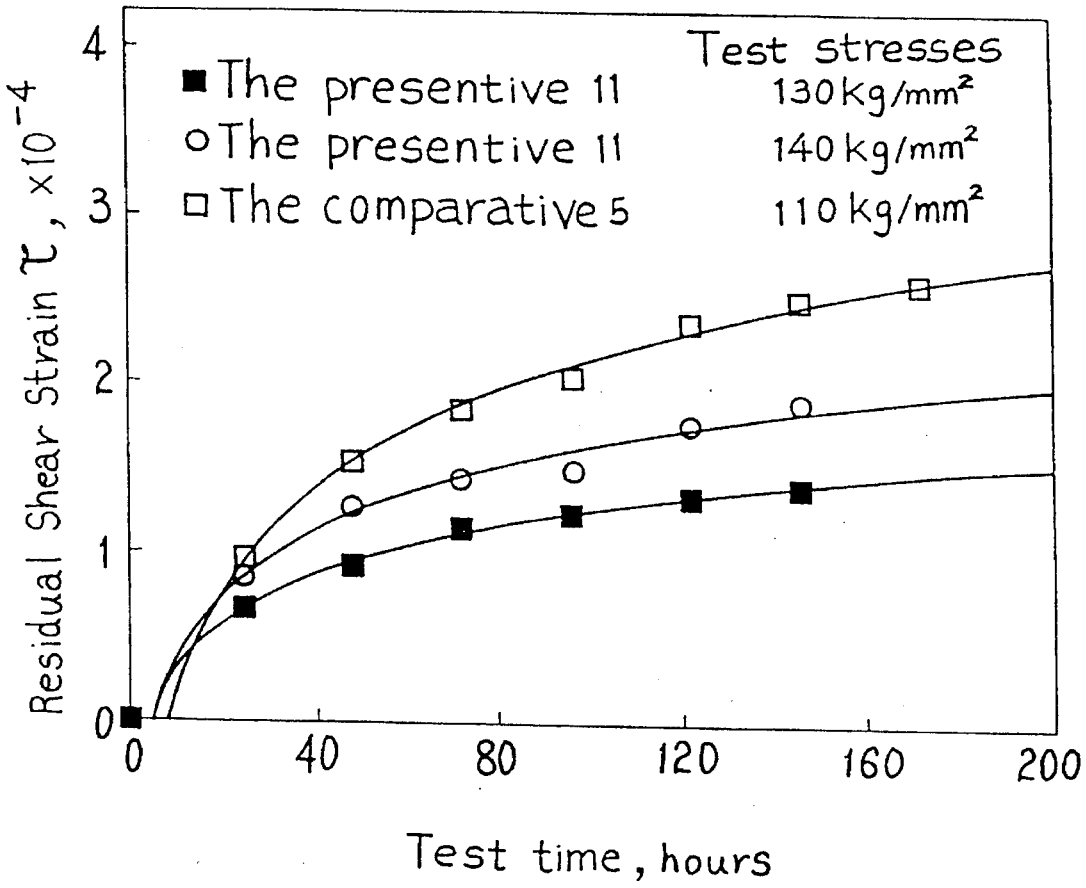
FIGS. 4 and 5 illustrate the measured values of the static sag resistance at the room temperature.

FIG. 4 illustrates a comparison of the room temperature static sag resistances for the test piece 11 of the present invention (measured under test stresses of 130 and 140 $kg/mm^2$), and for the comparative test piece 5 tested under a test stress of 110 $kg/mm^2$.

Figure 3:
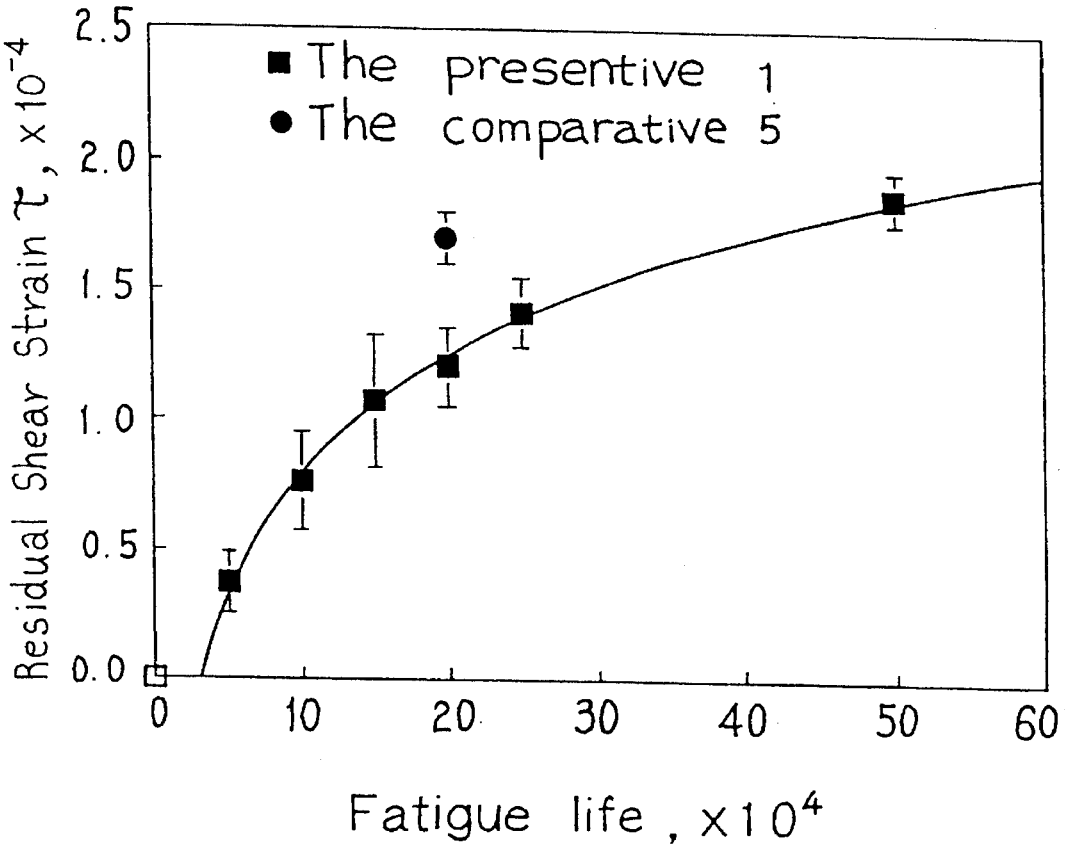
FIG. 3 illustrates the measured values of the dynamic sag resistance.

As shown in FIG. 3, in the case of the test piece 11 of the present invention, a trend is seen such that, as the fatigue life expectancy increases, the residual shear strain τ is gradually increased. At the fatigue life expectancy of 200,000 strokes, the sag resistance of the test piece 11 of the present invention is superior over the comparative test piece 5.

Figure 5:
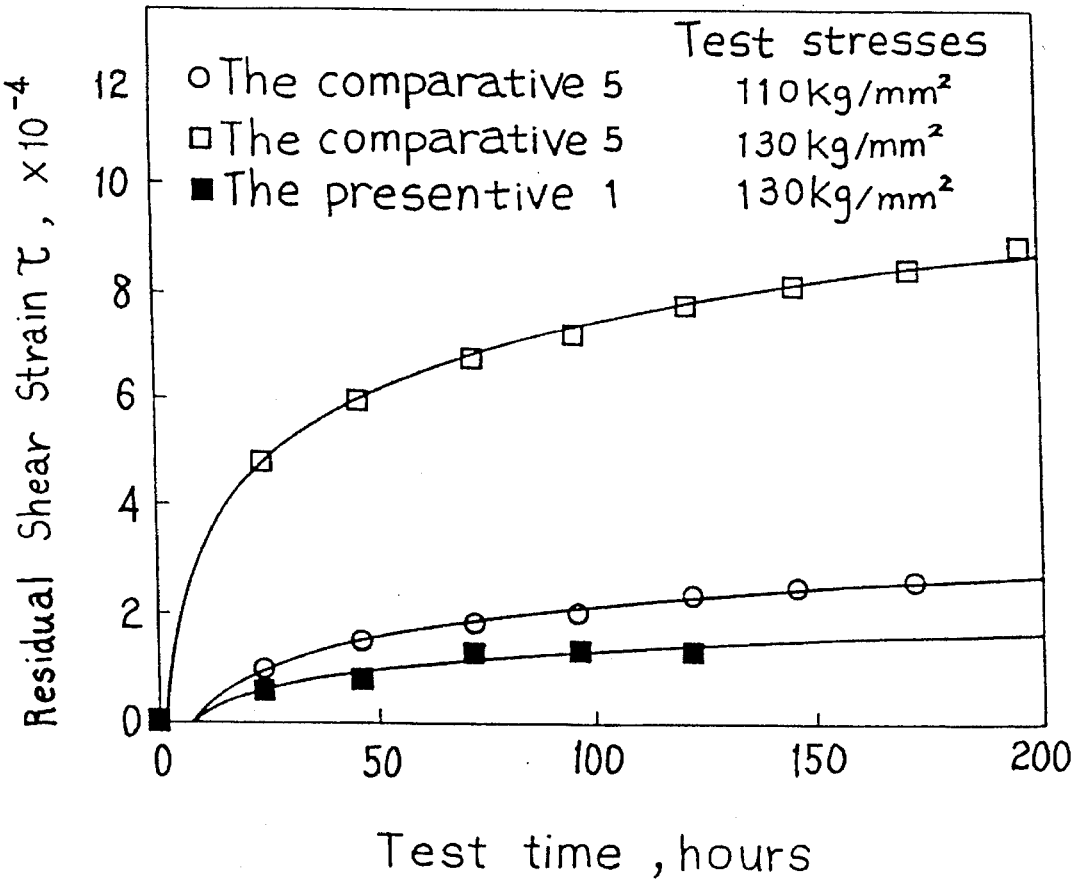

Further, as shown in FIGS. 4 and 5, the test piece 11 of the present invention shows superior sag resistance compared with the comparative test piece 5.

According to the present invention as described above, the spring steel of the present invention shows an improved sag resistance owing to the high silicon content compared with the conventional spring steel. The high decarburization caused by the high silicon content and the low toughness caused by the strengthening of the material can be overcome by adding nickel. Thus the excessive decarburization problem and the low toughness problem can be overcome, thereby providing an improved high strength high toughness spring steel.

What is claimed is:

1. A high strength high toughness spring steel comprising in weight %: 0.5–0.7% of C, 2.5–3.5% of Si, 0.3–0.6% of Mn, 0.3–0.6% of Cr, 0.15–0.25% of at least one of V and Nb, less than 0.02% of P, less than 0.02% of S, 1.5–2.5% of Ni, and other incidental impurities, the balance being Fe.

2. A process for manufacturing a high strength high toughness spring steel, comprising the steps of:

heating a spring steel to a temperature of 830°–870° C., said spring steel being composed in weight % of: 0.5–0.7% of C, 2.5–3.5% of Si, 0.3–0.6% of Mn, 0.6% of Cr, 0.15–0.25% of at least one of V and Nb, less than 0.02% of P, less than 0.02% of S, 1.5–2.5% of Ni, and other incidental impurities, the balance being Fe;

austenitizing said spring steel at a temperature of 830°–870° C.;

quenching said spring steel; and tempering said spring steel at a temperature of 320°–420° C.

* * * * *

UNITED STATES PATENT AND TRADEMARK OFFICE

CERTIFICATE OF CORRECTION

PATENT NO. : 5,575,973

DATED : November 19, 1996

INVENTOR(S) : Hae C. Choi, Won J. Nam, Jong K. Choi, Soo D. Bark, Jong H. Choi and Jang G. Kim It is certified that error appears in the above-indentified patent and that said Letters Patent is hereby corrected as shown below:

Column 2 Line 37 "Hei1-184259" should read --Hei-1-184259--.

Column 7 Line 15 after "and" insert --3--.

Claim 2 Lines 31-32 Column 14 "0.6% of Cr," should read --0.3-0.6% of Cr,--.

Signed and Sealed this

Eighth Day of April, 1997

Bruce Lehman

*Attest:*

BRUCE LEHMAN

*Attesting Officer*

*Commissioner of Patents and Trademarks*